US007055214B1

(12) United States Patent
Finkelstein

(10) Patent No.: US 7,055,214 B1
(45) Date of Patent: Jun. 6, 2006

(54) ANTI-SAG HINGE

(75) Inventor: Burl Finkelstein, Newnan, GA (US)

(73) Assignee: Kason Industries, Inc., Shenandoah, GA (US)

( * ) Notice: Subject to any disclaimer, the term of this patent is extended or adjusted under 35 U.S.C. 154(b) by 0 days.

(21) Appl. No.: 10/944,652

(22) Filed: Sep. 20, 2004

(51) Int. Cl.
*E05D 7/04* (2006.01)

(52) U.S. Cl. ..... 16/248; 16/242

(58) Field of Classification Search ..... 16/248, 16/235, 242, 249, 271, 366, 247, 382, 236, 16/237, 239; 312/326, 329, 405
See application file for complete search history.

(56) References Cited

U.S. PATENT DOCUMENTS

| | | | | | |
|---|---|---|---|---|---|
| 2,027,888 | A * | 1/1936 | Solomon | 16/249 |
| 2,581,104 | A * | 1/1952 | Houlsby, Jr. | 16/249 |
| 2,615,194 | A * | 10/1952 | Kreiner | 16/248 |
| 3,626,548 | A * | 12/1971 | Grunert | 16/358 |
| 3,866,658 | A * | 2/1975 | Smith | 160/206 |
| 4,156,301 | A * | 5/1979 | Schneider et al. | 16/249 |
| 4,407,044 | A * | 10/1983 | Iseki | 16/237 |
| 5,218,739 | A * | 6/1993 | Lautenschlager | 16/355 |
| 5,491,930 | A * | 2/1996 | La See | 49/252 |
| 6,049,946 | A * | 4/2000 | Cress et al. | 16/240 |
| 6,152,554 | A * | 11/2000 | Parisi | 312/405 |
| 6,202,255 | B1 * | 3/2001 | Sitter | 16/242 |
| 6,374,458 | B1 * | 4/2002 | Finkelstein | 16/235 |

* cited by examiner

*Primary Examiner*—Chuck Y. Mah
*Assistant Examiner*—Mark T. Vogelbacker
(74) *Attorney, Agent, or Firm*—Baker Donelson

(57) ABSTRACT

An anti-sag hinge (10) is disclosed which includes a mounting flange (12), a strap assembly (15) and a cover plate (17). The strap assembly includes a top flange (18), a bottom flange (19) and a strap (25) extending between the top flange and bottom flange. The strap has an inner surface (30) defines a plurality of raised or serrated edges (30)*a* and three elongated openings (36). The mounting flange includes a back surface (71) which has an elongated recess (77) with an exterior facing wall surface or floor (82) that has a texture of raised or serrated edges (84). Three elongated openings (87) extend through the mounting flange. The hinge further includes a strap assembly adjustment plate (100) configured to fit against the inner surface of the strap. The strap assembly adjustment plate has three countersunk round openings (102) there through. The mounting flange adjustment plate (101) is configured to fit against the exterior facing surface. The mounting flange adjustment plate has three round openings (103) there through which are configured to cooperate with the openings in the mounting flange. The strap assembly adjustment plate provides a back side (106) that is characterized by a plurality of raised serrated edges (108). Similarly, the mounting flange adjustment plate provides a front side (116) that is characterized by a plurality of raised serrated edges (118).

16 Claims, 2 Drawing Sheets

ANTI-SAG HINGE

TECHNICAL FIELD

This invention relates generally to door hinges, and more particularly to anti-sag hinges used for commercial refrigerator and freezer doors.

BACKGROUND OF THE INVENTION

It has become commonplace to offer refrigerated products directly to the public in a variety of stores. For example, roadside convenience stores and gas stations have long offered refrigerated drinks in ice buckets and other readily accessible devices whereby the individual selected and obtained the drink or other refrigerated item without assistance. A preferred method of self service delivery of such products has become to provide one or more publicly accessible refrigerators or freezers that both present the drink (or other refrigerated product) and serve to dispense it as well. Thus, an individual may enter a convenience store and find an entire wall of refrigerated cabinets. Each cabinet is provided with one or more display devices that facilitate storage and retrieval of a multitude of products, ranging from soft drinks to dairy products such as ice cream and other consumer food products. The individual thus opens the door to the refrigerator or freezer and "reaches-in" to retrieve the desired item. This arrangement has been very successful. Accordingly, more and different establishments are providing such refrigerators and freezers. For example, one may encounter reach-in refrigerators and freezers in airport concession stores, sandwich shops, restaurants, schools, hospitals, sports arenas, office buildings, and almost any other type of commercial establishment where a demand exists for ready access to refrigerated products.

It is to be appreciated that reach-in refrigerators and freezers are typically provided in high-use situations. As a result, the refrigerator and freezer doors are repeatedly opened and closed by many different people. For example, a convenience store reach-in refrigerator door may be opened and closed by persons of all ages, ranging from young children to the elderly. Many such individuals are careless with or inadvertently misuse the refrigerator door. For example, a young child may hang on the door while it closes. A person may lean against an open refrigerator door for physical support. A person may exert a downward force on the refrigerator door handle for any number of reasons. Of course, classic wear and tear on the door as a result of frequent use may cause the door to become mis-aligned on its hinges. As a result, the door itself "sags"or becomes mis-aligned with the jamb. This sagging causes a gap to develop between the door and cabinet that reduces the performance of the refrigeration and enables the entrance of vermin.

Thus, it is known that doors of commercial reach-in refrigerators sag and lose proper alignment with their respective opening of a refrigerator or freezer cabinet. It is further known that even new doors, due to manufacturing tolerances of either the door, the cabinet, or both, may not properly align with the opening. As a result, various prior art methods have been devised to correct for such sag and misalignment, including shimming, remounting the hinge and distorting the cabinet. However, each of these methods offered only an external method of addressing the misalignment problem.

An anti-sag hinge has been developed to compensate for sagging, as shown in U.S. Pat. Nos. 6,374,458 and 6,152, 554. In these designs, an adjustment plate is mounted to the interior surface of a mounting flange. The adjustment plate resides within a recess or well extending into the mounting flange. This recess forces the mounting flange to be larger than necessary in order to compensate for both the well and the thickness necessary to retain the weight of the door. The existence of the recess also necessitates the existence of a separate cover or plug to cover the recess, to prevent food or other matter from being accidentally retained within the recess.

These types of hinges also must meet the requirements of cleanability and maintenance set by the National Sanitation Foundation (NSF). These requirements dictate that hinges used on commercial food handling equipment must have no uncleanable openings or recessed areas. Covered areas may present hinges with uncleanable areas.

Accordingly, there is a need in the art for an apparatus and method for compensating for the sag or misalignment of reach-in refrigerator and freezer doors that is internal to the door hinge. It is to the provision of such therefore that the present invention is primarily directed.

SUMMARY OF THE INVENTION

In a preferred form of the invention an anti-sag hinge for doors being suited from mating engagement with an associated cabinet or jamb comprises a mounting flange adapted to be mounted to a jamb, the mounting flange having an exterior facing surface and a plurality of screw openings there through, the exterior facing surface having a select texture. The hinge also has a strap assembly adapted to be mounted to a door and pivotally coupled to the mounting flange, the strap assembly having a plurality of screw openings there through. The hinge further includes a mounting flange adjustment plate having a plurality of screw openings there through configured to be alignable with the mounting flange screw openings, the mounting flange adjustment plate also have an interior facing surface having a select texture which is mateably in different positions with the mounting flange exterior facing surface select texture. With this construction, the door is adjusted relative to the jamb by movement of the mounting flange adjustment plate relative to the mounting flange, and the mounting flange adjustment plate is locked in position by the mating of the mounting flange exterior facing surface texture with the mounting flange adjustment plate interior facing surface texture.

DETAILED DESCRIPTION

Figure 1:
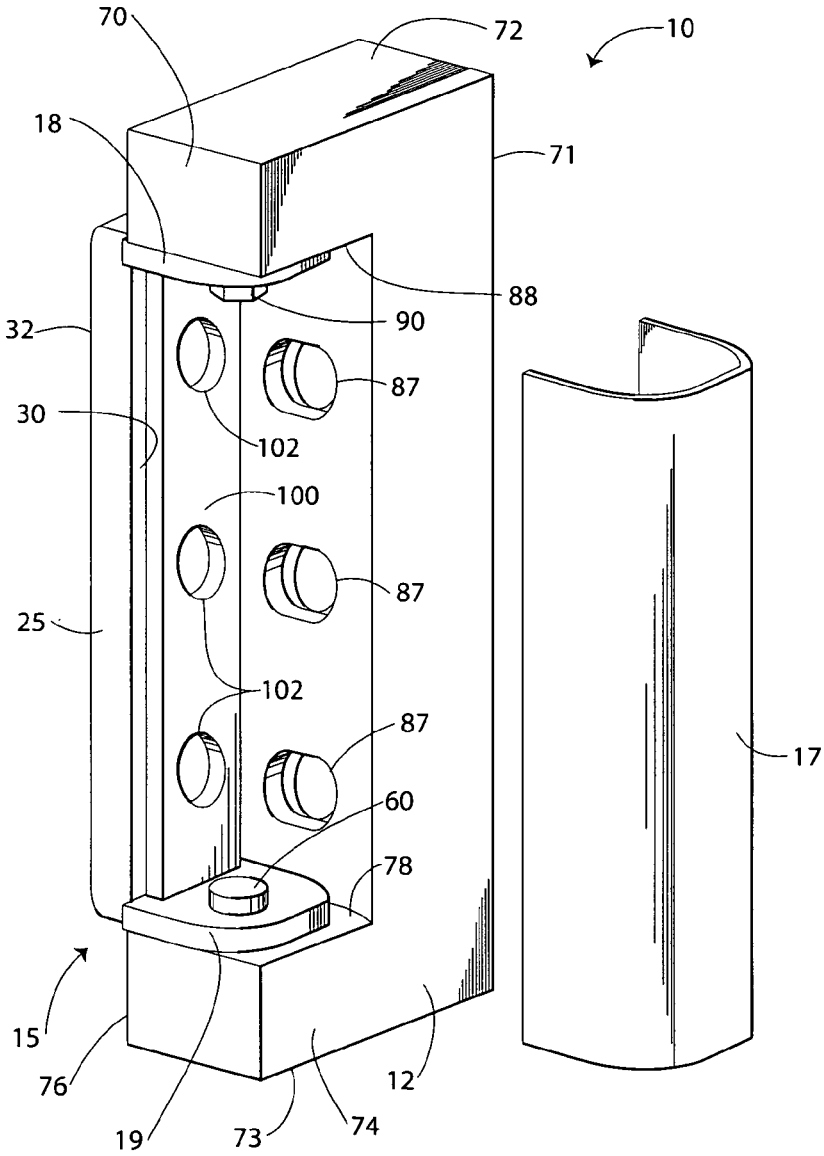
FIG. 1 is a perspective view of the hinge embodying principles of the invention in a preferred form, shown with the cap disengaged for clarity.
Figure 2:
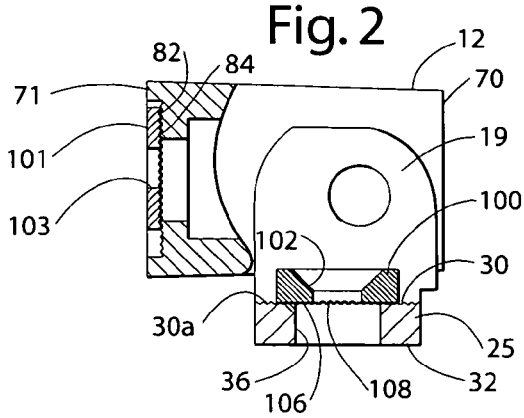
FIG. 2 is a cross-sectional top view of the hinge of FIG. 1.
Figure 3:
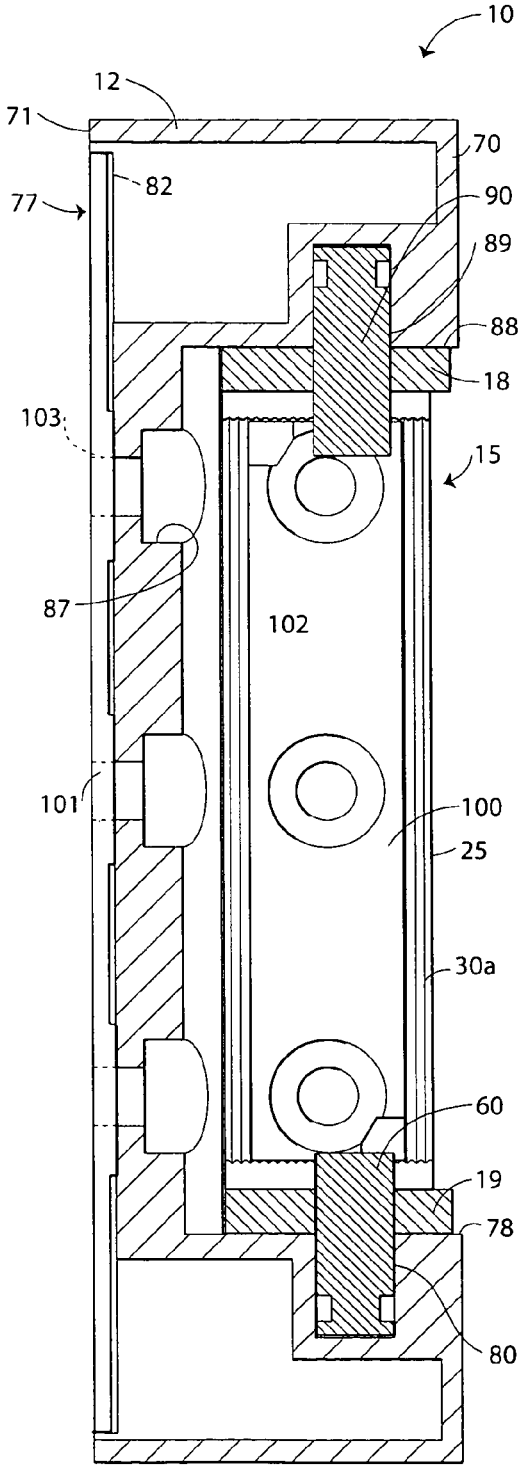
FIG. 3 is a cross-sectional side view of the hinge of FIG. 1.
Figure 4:
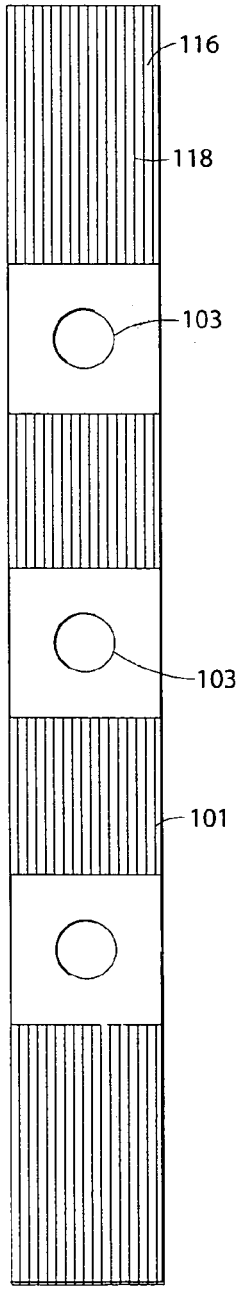
FIG. 4 is a front view of the mounting flange adjustment plate.
Figure 5:
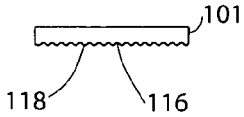
FIG. 5 is an end view of the mounting flange adjustment plate.
Figure 6:
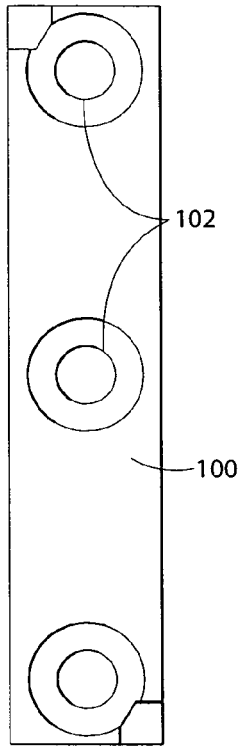
FIG. 6 is a front view of the strap assembly adjustment plate.
Figure 7:
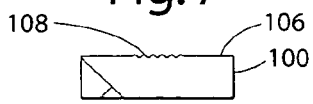
FIG. 7 is an end view of the strap assembly adjustment plate.

With reference next to the drawings, there is shown a an anti-sag hinge 10 according to the present invention. The hinge 10 includes a mounting flange 12, a strap assembly 15 and a cover plate 17. The cover plate 17 is a generally U-shaped member that may be made of any suitable material and finish, including steel, aluminum and plastic. The cover 17 is provided for many reasons, including aesthetics and to meet the sanitary requirements employed in the industry as specified by the National Sanitation Foundation.

It is to be appreciated that the hinge 10 shown in the drawings is an edge mounted hinge and is specially configured for use with a reach-in refrigerator or freezer door. The cabinets for which such doors are intended are well-known in the art and need not be disclosed further herein. It is to be further appreciated that the hinge 10, either alone or in combination with another hinge in accordance with the present invention, support a door (not shown) in the usual manner.

The strap assembly 15 includes a top flange 18, a bottom flange 19 and a strap 25 extending between the top flange 18 and bottom flange 19. The strap 25 is substantially rectangular in shape and defines an inner surface 30 and an outer surface 32. The inner surface 30 defines a plurality of raised or serrated edges 30*a*. The strap 25 defines three elongated openings 36 which are referenced in greater detail herein below.

It is to be understood that the cover plate 17 is configured for mating and frictional engagement with the strap assembly 15 to protect and seal the interior of the strap assembly.

The mounting flange 12 includes a front surface 70, a back surface 71, a top surface 72, a bottom surface 73, a side 74 and another side 76. The back surface 71 includes an elongated recess 77. The mounting flange includes a shelf 78 that defines an opening 80 for receipt of a mounting pin 60. The mounting pin 60 is fixedly retained within the opening 80. The flange 12 further includes an exterior facing wall surface or floor 82 within recess 77 that has a texture of raised or serrated edges 84. Three elongated openings 87 extend through the mounting flange which facilitate mounting of the hinge 10 as described below. The mounting flange also includes an overhang 88 having an opening 89 therein for receipt of a mounting bolt 90. The mounting bolt 90 extends through the top flange 18 of the strap assembly while the mounting pin 60 extends through the bottom flange 19 to couple the strap assembly to the mounting flange for pivotal movement.

The preferred hinge 10 further includes a strap assembly adjustment plate 100 configured to fit against the inner surface 30 of the strap 25. The strap assembly adjustment plate 100 has three countersunk round openings 102 there through. Openings 102 are configured to cooperate with openings 36 in surface 30 of the strap assembly 15. Similarly, a mounting flange adjustment plate 101 is configured to fit against the exterior facing surface 82 of the mounting flange. The mounting flange adjustment plate 101 has three round openings 103 there through. Openings 103 are configured to cooperate with the openings 87 in the mounting flange 12. These openings are all preferably sized to accommodate flat head screws (not shown), which are commonly used to support reach-in refrigerator and freezer doors. The strap assembly adjustment plate 100 provides a back side 106 that is characterized by a plurality of raised serrated edges 108. It is to be further understood that the backside 106 is to be placed against the interior surface of the strap assembly 15. It is to be further understood that the openings 102 are configured to receive flat head screws so that in a flush mounted manner. Thus, each opening 102 is expanded at its upper end to receive the head of such a screw. Yet further, it is to be appreciated that the openings 102 are circular in configuration, whereas the openings 36 in the strap assembly 15 are slotted in configuration. As described below, such configurations provide for the internal adjustment necessary to effect correction of door mis-alignment.

Similarly, the mounting flange adjustment plate 101 provides a front side 116 that is characterized by a plurality of raised serrated edges 118. It is to be further understood that the front side 116 is to be placed against the exterior facing surface 82 of the mounting flange 12. It is to be further understood that the mounting flange openings 87 are configured to receive pan head or pilaster head. Thus, each opening 87 is expanded at its upper end to receive the head of such a screw. Yet further, it is to be appreciated that the openings 103 are circular in configuration, whereas the openings 87 in the mounting flange 12 are slotted in configuration. As described below, such configurations provide for the internal adjustment necessary to effect correction of door mis-alignment.

In use, the hinge 10 is mounted to the refrigerator or freezer door in the conventional manner as is well known in the art. The mounting flange 12 is secured to the jamb by the use of screws (not shown) that extend between the flange and the cabinet. However, in accordance with the present invention, the screws first extend through openings 87 in the mounting flange then through the mounting flange adjustment plate openings 103, the mounting flange adjustment plate 101 being placed against the mounting flange exterior facing surface 82. The screws next engage the cabinet jamb (not shown). The adjustment plate 101 is preferably initially in a true vertical alignment so as to be centered within the mounting flange 12.

A conventional reach-in refrigerator or freezer door is similarly secured to the hinge 10 by three screws (not shown) that extend through the strap assembly adjustment plate openings 36 and through the strap assembly openings 36. The strap assembly adjustment plate 100 is secured against the interior surface 30 of the strap in preferably a true vertical alignment so as to be centered within the strap assembly 15. However, as is known in the art, the cabinet or the door or both may not be true due to manufacturing tolerances, damage to either or other reasons. Accordingly, the installer may adjust for such discrepancies by manipulating the position of the adjustment plates 100 and/or 101 within the hinge 10. More particularly, the installer may move the adjustment plates 100 and 101 as necessary to the extent permitted by the slotted openings 36 and 87 to facilitate proper alignment of the door to the cabinet. In like fashion, in the event that proper alignment of the door is disturbed as a result of use, the installer need only remove the cover plate 17 to gain access to the interior of the hinge 10 and then manipulate either adjustment plate 100 or 101 to effect correction of the alignment. More particularly, the installer would need only to loosen the appropriate screws to permit manipulation of the door. Then, once the door is moved but yet still support by the hinge, the installer can position the door so as to align it to the cabinet, and then re-tighten the screws to secure the doors position and corrected alignment.

Thus, the present invention fulfills the need in the art for an apparatus and method for compensating for the sag or misalignment of reach-in refrigerator and freezer doors that is internal to the door hinge. This need is fulfilled by providing an anti-sag hinge for commercial reach-in refrigerator or freezer doors that includes adjustment plates 100 and 101 that permit correction of alignment both during initial installation of the door to the cabinet and realignment of the door due to frequent opening and closing of such doors.

It should be understood that by positioning the mounting flange adjustment plate 101 to the exterior of the mounting flange the recess associated with hinges of the prior art is eliminated. The elimination of the recess enables the flange to be made thinner. This also eliminates the possibility of food becoming trapped or caught within the recess, and therefore increases the sanitary capabilities of the hinge.

It should be understood that while the texture of the adjustment plates and corresponding mounting flange exterior surface and strap assembly interior surface are shown as elongated serrations, other mateable textures may be utilized to cause multi-positioned mating engagement between the adjustment plates and their corresponding components.

While this invention has been described in detail with particular reference to the preferred embodiments thereof and the best mode of practicing same, it will be understood that variations and modifications can be effected within the spirit and scope of the invention as described hereinabove and as set forth in the appended claims.

The invention claimed is:

1. An anti-sag hinge for doors being suited from mating engagement with an associated cabinet or jamb, the anti-sag hinge comprising:

a mounting flange adapted to be mounted to a jamb, said mounting flange having an exterior facing surface facing the jamb, with a recess therein, said recess having a floor with a select texture, said mounting flange also having a plurality of screw openings there through;

a strap assembly adapted to be mounted to a door and pivotally coupled to said mounting flange, said strap assembly having a plurality of screw openings there through; and a mounting flange adjustment plate having a plurality of screw openings there through configured to be alignable with said mounting flange screw openings, said mounting flange adjustment plate also have an interior facing surface having a select texture which is mateable in different positions with said mounting flange exterior facing surface select texture, whereby the door is adjusted relative to the jamb by movement of the mounting flange adjustment plate relative to the mounting flange, and whereby the mounting flange adjustment plate is locked in position by the mating of the mounting flange exterior facing surface texture with the mounting flange adjustment plate interior facing surface texture.

2. The anti-sag hinge of claim 1 wherein said mounting flange screw openings are elongated.

3. The anti-sag hinge of claim 2 wherein said mounting flange adjustment plate screw openings are round.

4. The anti-sag hinge of claim 1 wherein said mounting flange exterior surface select texture is a plurality of serrated edges and wherein said mounting flange adjustment plate interior facing surface select texture is a plurality of serrated edges.

5. The anti-sag hinge of claim 1 wherein said strap assembly includes an inner surface having a select texture and wherein said anti-sag hinge further comprises a strap assembly adjustment plate having a plurality of screw openings there through configured to be alignable with said strap assembly screw openings, said strap assembly adjustment plate also have a first surface having a select texture which is mateably in different positions with said strap assembly inner surface select texture.

6. The anti-sag hinge of claim 5 wherein said strap assembly screw openings are elongated.

7. The anti-sag hinge of claim 6 wherein said strap assembly adjustment plate screw openings are round.

8. The anti-sag hinge of claim 5 wherein said strap assembly inner surface select texture is a plurality of serrated edges and wherein said strap assembly adjustment plate first surface select texture is a plurality of serrated edges.

9. An anti-sag hinge for doors being suited from mating engagement with an associated cabinet or jamb, the anti-sag hinge comprising:

a mounting flange adapted to be mounted to a jamb, said mounting flange having an exterior facing surface facing the jamb, with a recess therein, said recess having a floor with a select texture, said mounting flange also having a plurality of screw openings there through;

a strap assembly adapted to be mounted to a door and pivotally coupled to said mounting flange, said strap assembly having a plurality of screw openings there through; and a mounting flange adjustment plate having a plurality of screw openings there through configured to be alignable with said mounting flange screw openings, said mounting flange adjustment plate being sized and shaped to reside at least partially within said mounting flange recess, said mounting flange adjustment plate also have an interior facing surface having a select texture which is mateable in different positions with said mounting flange recess floor select texture, whereby the door is adjusted relative to the jamb by movement of the mounting flange adjustment plate relative to the mounting flange, and whereby the mounting flange adjustment plate is locked in position by the mating of the mounting flange recess floor texture with the mounting flange adjustment plate interior facing surface texture.

10. The anti-sag hinge of claim 9 wherein said mounting flange screw openings are elongated.

11. The anti-sag hinge of claim 10 wherein said mounting flange adjustment plate screw openings are round.

12. The anti-sag hinge of claim 9 wherein said mounting flange recess floor select texture is a plurality of serrated edges and wherein said mounting flange adjustment plate interior facing surface select texture is a plurality of serrated edges.

13. The anti-sag hinge of claim 9 wherein said strap assembly includes an inner surface having a select texture and wherein said anti-sag hinge further comprises a strap assembly adjustment plate having a plurality of screw openings there through configured to be alignable with said strap assembly screw openings, said strap assembly adjustment plate also have a first surface having a select texture which is mateably in different positions with said strap assembly inner surface select texture.

14. The anti-sag hinge of claim 13 wherein said strap assembly screw openings are elongated.

15. The anti-sag hinge of claim 14 wherein said strap assembly adjustment plate screw openings are round.

16. The anti-sag hinge of claim 13 wherein said strap assembly inner surface select texture is a plurality of serrated edges and wherein said strap assembly adjustment plate first surface select texture is a plurality of serrated edges.

* * * * *